US005561345A

United States Patent [19]

Kuo

[11] Patent Number: 5,561,345

[45] Date of Patent: Oct. 1, 1996

[54] FOCUSING AND STEERING ELECTRODES FOR ELECTRON SOURCES

[76] Inventor: Huei-Pei Kuo, 924 Old Town Ct., Cupertino, Calif. 95014

[21] Appl. No.: 437,066

[22] Filed: May 9, 1995

Related U.S. Application Data

[63] Continuation of Ser. No. 124,084, Sep. 20, 1993, abandoned.

[51] Int. Cl.[6] ..... H01J 1/62

[52] U.S. Cl. ..... 313/495; 313/488

[58] Field of Search ..... 313/495, 488

[56] References Cited

U.S. PATENT DOCUMENTS

| | | | |
|---|---|---|---|
| 4,020,387 | 4/1977 | Coates et al. | 315/382 |
| 4,498,952 | 2/1985 | Christensen | 548/375.1 |
| 4,531,122 | 7/1985 | Redfield | 345/74 |
| 4,554,564 | 11/1985 | van Gorkom et al. | 346/161 |
| 4,719,388 | 1/1988 | Oess | 315/169 |
| 5,194,884 | 3/1993 | Parker et al. | 353/122 |
| 5,212,426 | 5/1993 | Kane | 315/169.1 |
| 5,237,180 | 8/1993 | Anagnostopoulos et al. | 250/423 F |
| 5,281,890 | 1/1994 | Kane | 313/309 |
| 5,347,201 | 9/1994 | Liang et al. | 315/366 |

FOREIGN PATENT DOCUMENTS

| | | | |
|---|---|---|---|
| 0271926 | 6/1988 | European Pat. Off. | H01J 31/12 |
| 0349425 | 6/1989 | France | H01J 31/15 |
| 2127616 | 4/1984 | United Kingdom | H01J 29/98 |

OTHER PUBLICATIONS

U.S. application No. 08/024,726, Mar. 1, 1993, Huei-Pei Kuo.

Jones et al., "Fabrication of Silicon Point, Wedge, and Trench FEAs", Technical Digest of Int. Vacuum Microelectronics Conf., 1991.

Spindt et al., "Physical Properties of Thin-Film Field Emission Cathodes with Molybdenum Cones", Journal of Applied Physics, vol. 47, No. 12, Dec. 1976.

*Primary Examiner*—Donald J. Yusko
*Assistant Examiner*—Lawrence O. Richardson

[57] ABSTRACT

Apparatus and methods of focusing and to steering a group of electrons emitted from an electron source to a shield. In a preferred embodiment, the apparatus includes an electron source controlled by one or more voltages to emit electrons, a first electrode adjacent to one side of the source, and a second electrode, insulated from the first electrode, adjacent to an opposite side of the source. The shield has a shield voltage. The first and the second electrode have a first and a second voltage respectively to focus and steer a substantial portion of the emitted electrons towards the shield. One application of the present invention is in the area of flat panel displays with the shield being a screen.

8 Claims, 3 Drawing Sheets

FOCUSING AND STEERING ELECTRODES FOR ELECTRON SOURCES

CROSS REFERENCE TO RELATED APPLICATION

This is a continuation of application Ser. No. 08/124,084, filed on Sep. 20, 1993, now abandoned.

BACKGROUND OF THE INVENTION

The present invention relates generally to electron sources, and more particularly to focusing and steering electrons from the electron sources, such as field emitters.

An easy-to-build flat panel display has been considered as the "Holy Grail" in electronics. Numerous researchers have been trying to invent such a display. One of the hurdles of the display is to easily and inexpensively focus and steer the electrons emitted from the electron sources to the screen of the display.

Various devices have been used to focus and steer the emitted electrons. One method depends on layers of metallic grides hanging directly above the sources. Displays with these grids are expensive and difficult to make reliably.

Another method, known as the "switched anode" method, depends on positioning the screen of the display very close to the electron sources and then dynamically varying voltages on the screen to attract and to guide the electrons. To prevent voltage breakdown between the screen and the electron sources, the voltage difference between the screen and the sources should be low. With a significant portion of the electrons attracted to the gates controlling the sources and missing the screen, the power efficiency of the display is low. Also, the voltage on the screen typically limits the brightness of the display, and the potential difference between adjacent stripes on the screen limit the resolution of the display.

It should be apparent from the foregoing that there is still a need for apparatus and methods to efficiently focus and steer electrons in a flat panel display.

SUMMARY OF THE INVENTION

The present invention provides methods and apparatus to focus and steer electrons efficiently from the electron sources to the screen of a flat panel display.

This invention does not need layers of metal grids hanging on top of the sources to focus and to steer the emitted electrons from the sources in the display. Those grids are not easy to build and are difficult to assemble. This invention also does not need to guide the emitted electrons by dynamically varying voltages on the screen, as in the switching anode method. The power efficiency, brightness and the resolution of a display by the switching anode method usually are low. In the present invention, images on the screen are expected to have a resolution better than 150 microns and to consume more than 90% of the total energy in the emitted electrons. The high power efficiency generates bright images. The present invention also does not need a sheet of material hanging between the sources and the screen to focus the emitted electrons.

In one preferred embodiment, the invented apparatus includes a first electron source, a first electrode, a second electrode and a shield. The first electron source has a first side and a second side that is approximately opposite to the first side. The first electrode is preferrably on first side and the second electrode preferrably on the second side. The two electrodes are insulated from each other. The electron source is controlled by one or more voltages to emit electrons. The shield has a shield voltage. The first electrode with a first voltage, and the second electrode with a second voltage focus and steer a substantial portion of the emitted electrons towards the shield. In another preferred embodiment, the electron source, the first and the second electrodes are on a substrate.

The present invention is expected to be capable of focusing electrons emitted from an electron source to a spot on a screen with a diameter of about 40 microns, 2 millimeters away from the source, and steering the spot across the screen by 300 microns, without increasing the spot diameter.

Other aspects and advantages of the present invention will become apparent from the following detailed description, taken in conjunction with the accompanying drawings, illustrating by way of example the principles of the invention.

Figure 1:
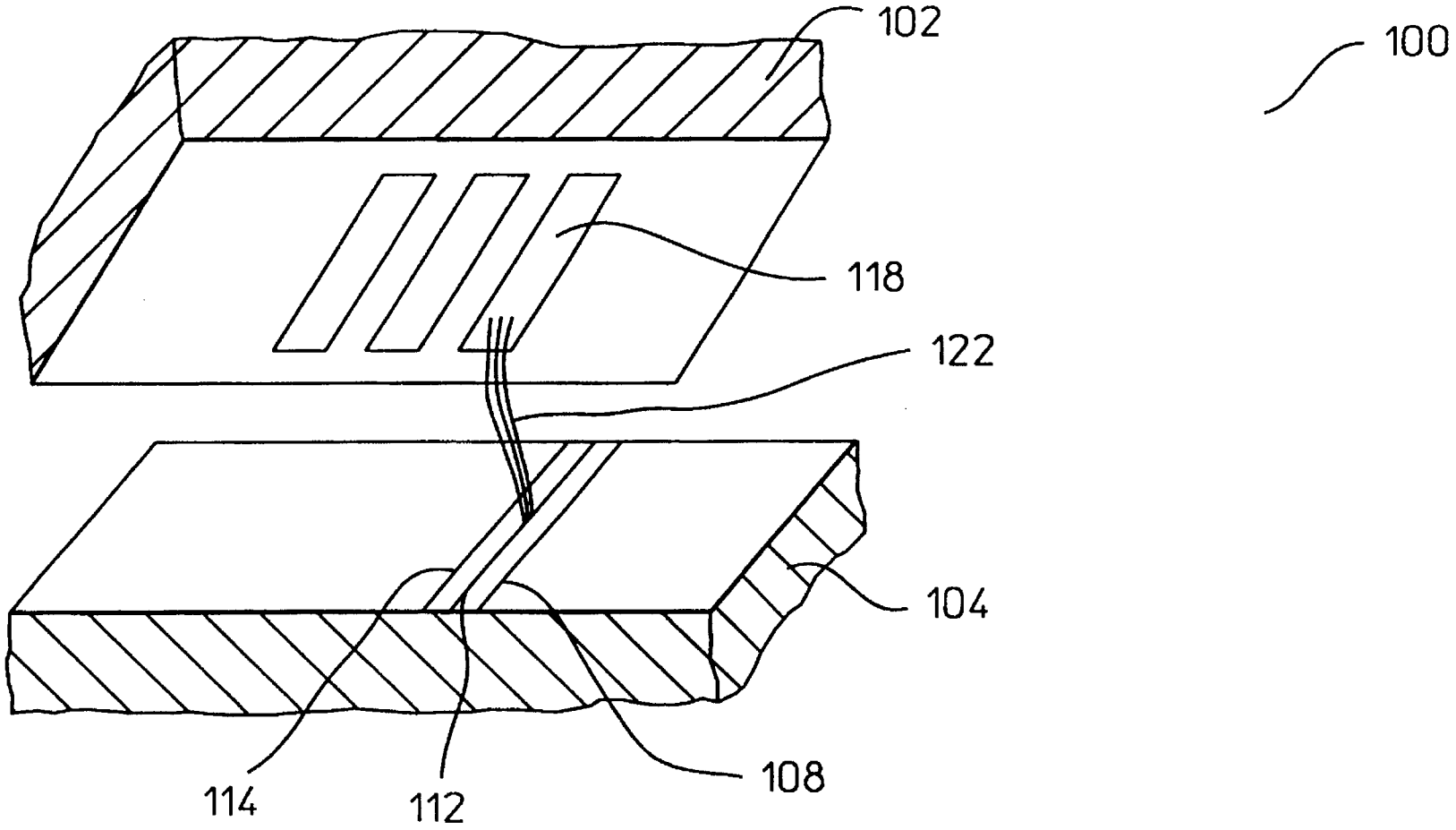
FIG. 1 shows a preferred embodiment of the present invention with a screen.
Figure 2:
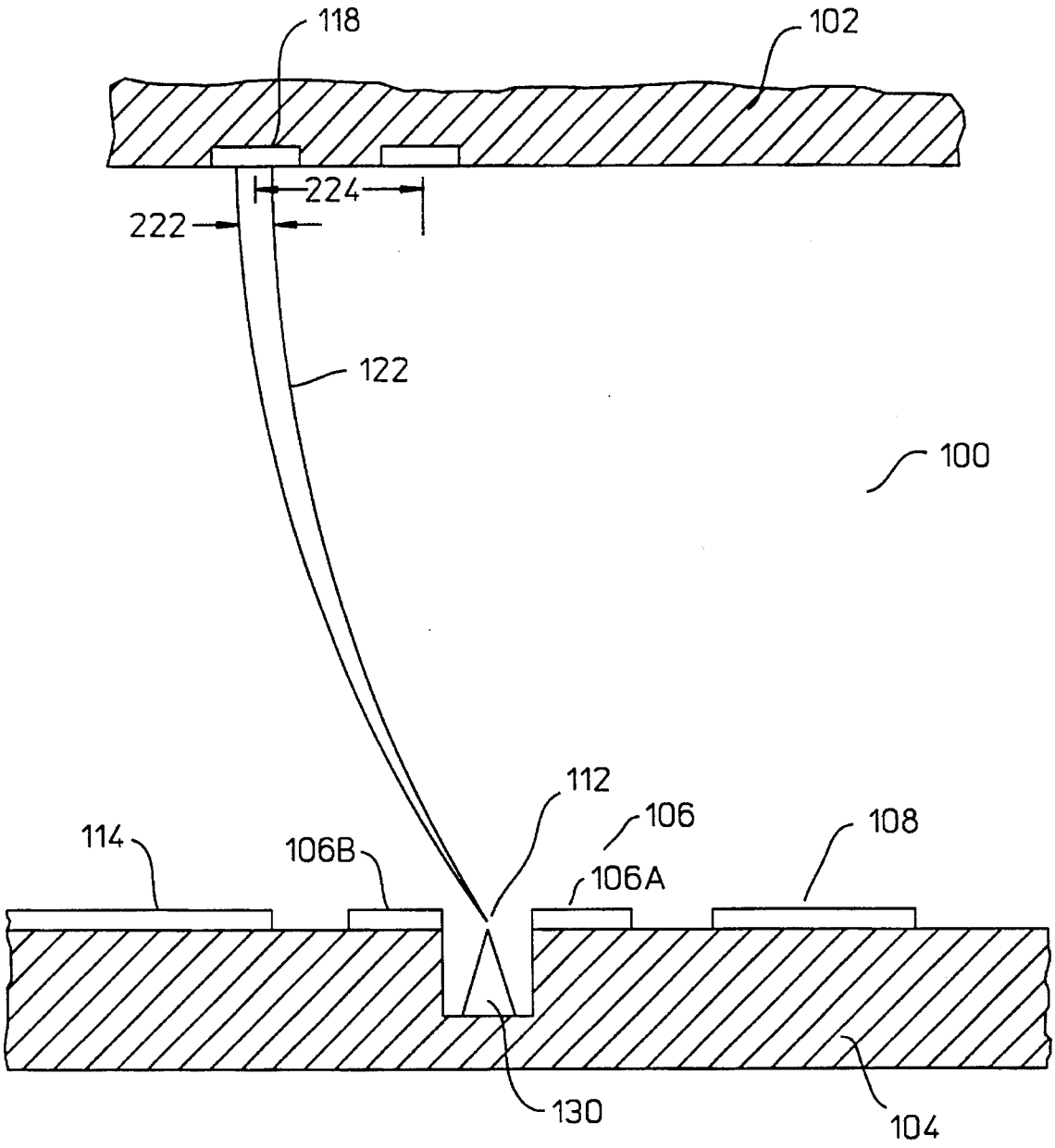
FIG. 2 shows a preferred embodiment of the invention with electrons from an electron source focused and steered towards a stripe on a screen.
Figure 3A:
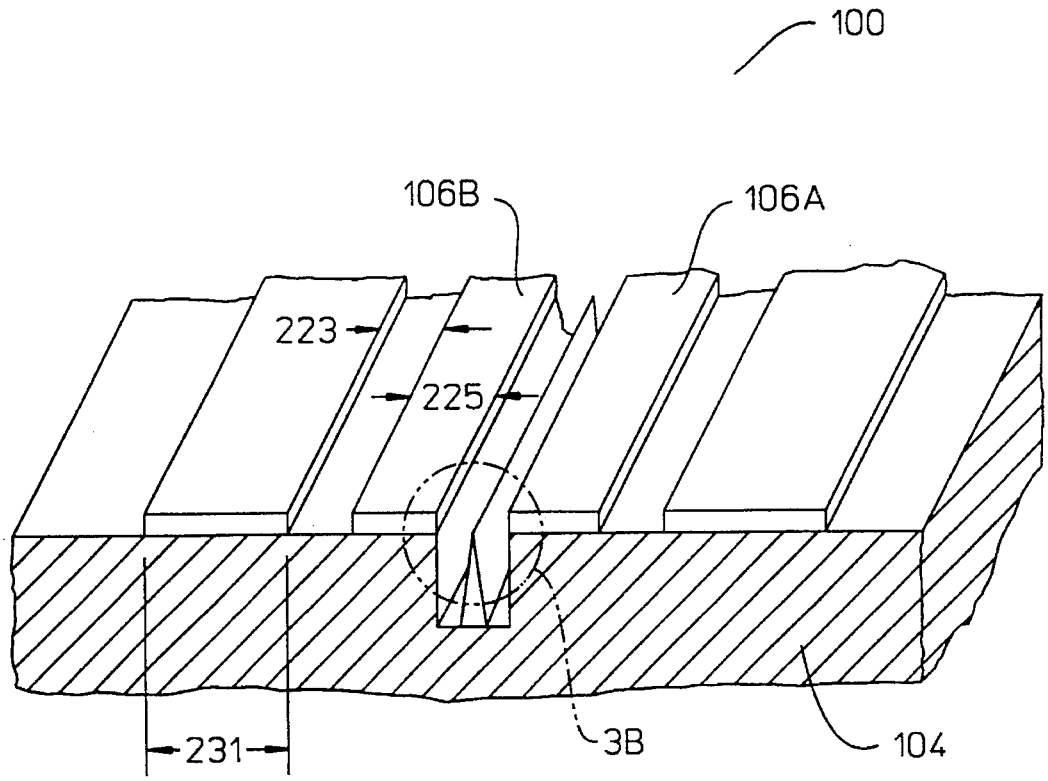
FIG. 3 shows, in more detail, a part of a preferred embodiment of the present invention.
Figure 3B:
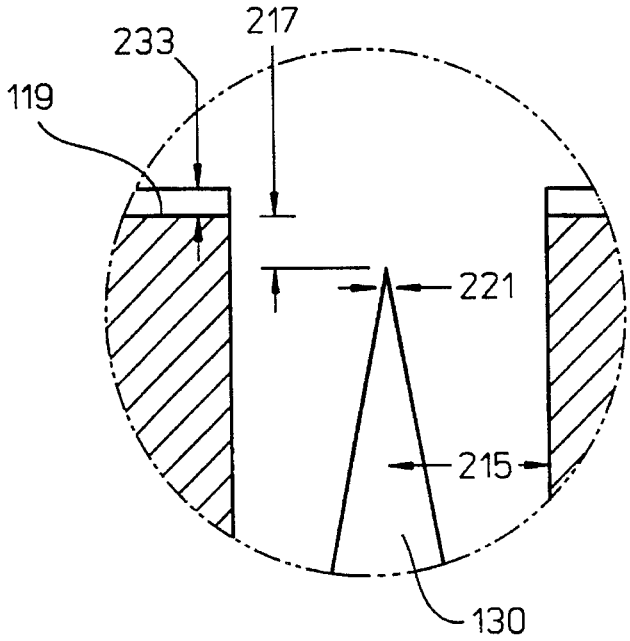

Same numerals in FIGS. 1 to 3 are assigned to similar elements in all the figures. Embodiments of the invention are discussed below with reference to FIGS. 1 to 3. However, those skilled in the art will readily appreciate that the detailed description given herein with respect to these figures is for explanatory purposes as the invention extends beyond these limited embodiments.

DETAILED DESCRIPTION OF THE INVENTION

FIG. 1 shows a preferred embodiment 100 of the present invention. The preferred embodiment includes a substrate 104, which has a plurality of electron sources, a first electrode 114 on one side of the sources, a second electrode 108 on an opposite side of the sources, and a shield 102. In one embodiment, the plurality of electron sources consist of a line emitter 112, which is a field emitter in the structure of a straight line. This type of field emitters is known in the art and, is shown, for example, in "Physical properties of thin-film field emission cathodes with molybdenum cones," by Spindt et al,. published in the Journal of Applied Physics, VOl. 47, No. 12, December 1976, and in "Fabrication of Silicon Point, Wedge, and Trench FEAs," by Jones et al., published in the Technical Digest of the International Vacuum Microelectronics Conference 1991.

The first electrode has a first potential, the second electrode has a second potential, and the shield has a shield voltage. The first and the second electrodes focus and steer the emitted electrons 122 towards the shield 102, which can be a screen of a flat panel display. The screen may have stripes, for example, the stripe 118, which when struck by electrons will emit light, forming images on the screen. For color displays, there are groups of three stripes on the screen, each stripe usually for a primary color. Depending on the desired color, electrons are steered towards that specific stripe.

FIG. 2 shows electrons from an electron source 112 being steered to the stripe 118 on the screen 102 and being focused into a beam-width 222 right next to the screen 102. The source 112 is a field emitter with an emitter 130 positioned in between the two sides 106A and 106B of a gate 106. The lateral distance 224 between the center of the beam of electrons to the source 112 is known as the beam deflection. The first electrode 114, the source 112 and the second electrode 108 are all on the substrate 104.

Relative to all the prior art methods of making flat panel displays, the present apparatus to focus and to steer the emitted electrons is very easy to build. The two electrodes 108, 114 can be deposited by thin film processes while the source 112 is fabricated. Moreover, with the screen 102 significantly further away from the substrate 104 than the switched anode method, the potential difference between the screen 102 and the substrate 104 can be significantly higher, while the potential difference between the source and the electrodes or between the emitter and the gate is very low. Therefore, though some electrons from the emitter 130 might land onto the electrodes or the gate, most of the energy of the electrons would be consumed in generating images on the screen 102.

FIG. 3 shows, in more detail, a portion of the preferred embodiment 100 of the present invention. The emitter 130, with its tip having a tip width 221, has the shape of a wedge; it is separated from the two sides 106A and 106B of the gate 106 by a tip lateral distance 215; and its tip is offset from the surface 119 where the gate 106 is positioned by a tip upper distance 217. The gate 106 and the electrodes 108 and 114, all have a similar thickness 233. Each side of the gate 106 has a gate width 225. Each side of the gate is separated by a gap width 223 from their corresponding electrodes. Each electrode also has an electrode width 231.

WORKING EXAMPLES

The invention will be further clarified by a consideration of the following examples, which are intended to be purely exemplary of the use of the invention.

The substrate 104 material is made of glass or oxidized silicon or other types of material with an insulating surface that is at least about 1 micron thick. The edge emitter 113 has the following preferred parameters: a tip width 221 of tens of Angstroms, a tip lateral distance 215 of 0.2 microns and a tip upper distance 217 of 0.1 micron. The thickness 233 of the gate 106 is about 0.1 microns. The gate width 225 is about 2 microns. The gap width 223 is about 3 microns and the electrode width 231 is about 100 microns. The screen 102 is about 2 millimeters from the substrate 104.

The potential on the line emitter, 130, is preferrably volt, the potential on the gate, 106, preferably ranges from 10 to 100 volts and is preferably at 40 volts, and the voltage on the screen, 102, preferably ranges from 100 to 10,000 volts and is preferably at 6500 volts. With these voltages, about 60% of the emitted electrons are expected to reach the screen, and about 90% of the total energy in the emitted electrons are expected to generate images on the screen. The following table shows the expected beam width 222 and beam deflection 224 as a function of the potentials on the first 114 and the second 108 electrodes. These expected values are calculated by standard electron optics calculations and should be obvious to those with ordinary skill in the art. A general discussion on this type of calculations can be found in "Electron Beams, Lenses and Optics," written by El-Kareh and El-Kareh, and published by the Academic Press in 1970.

As shown in the table, contrary to expectation, a structure as easy to build as the preferred embodiment can generate a high resolution display with their beams of electrons easily deflected from one stripe to the next on the screen by changing the voltages on the electrodes.

| Row Number | 1st Electrode Potential (volts) | 2nd Electrode Potential (volts) | Beam Width (microns) | Beam Deflection (microns) |
|---|---|---|---|---|
| 1 | 40 | 40 | 300 | 0 |
| 2 | −56 | 2 | 40 | −160 |
| 3 | −30 | −30 | 20 | 0 |
| 4 | 2 | −56 | 40 | 160 |

For a typical color VGA display, the center-to-center spacing between its stripes is about 100 microns. As shown in the 2nd to the 4th row of the table, a group of electrons with about forty microns beam width can be deflected by +/−160 microns by varying the voltages on the electrodes. The sensitivity of the beam deflection is about 5 microns for every 1 volt change on either one of the electrodes.

As shown in this example, the steering can be in terms of microns or one hundred microns. Typically, when a flat panel display is made, the sources of the display may not be exactly aligned to their corresponding stripes on the screen. The present invention can be used to correct the misalignment by steering the electrons towards their corresponding stripe. Also, the present invention can be used to dynamically steer electrons to different stripes on the screen, as is commonly practiced in color displays.

The control system to apply and to change the voltages on the electrodes, the emitter and the gate are not detailed here but should be well-known to those skilled in the art. The above structure and values serve as an example for the invention. For similar structures with different dimensions, the voltages would be different and can be found by standard electron-optic calculations.

From the foregoing it should be appreciated that methods and apparatus have been invented to easily focus and deflect electrons from electron sources to a shield. In the description, the source and the electrodes are on a substrate, but in general, as long as they are held in a rigid manner, they do not have to be on a substrate. The emitter, the gate and the electrodes do not have to be coplanar, one element can be on a plane higher than the other. Also, only one line emitter has been discussed, but it should be obvious that the invention can be extended to a plurality of electron sources or line emitters. In fact, the present invention is not limited to line emitters. Other types of electron sources can be used; for example, a point emitter, which is a field emitter with a sharp point. In that case, the first electrode is on one side and the second electrode is on an opposite side of the point. The present invention is also not limited to field emitters. Other electron sources can be used. Further, the present invention only describes two electrodes, additional electrodes could be used to steer and focus the emitted electrons. It should also be obvious that the invention can be applied to any applications or instruments that need to focus or to steer a group of electrons.

Other embodiments of the invention will be apparent to the skilled in the art from a consideration of this specification or practice of the invention disclosed herein. It is intended that the specification and examples be considered as exemplary only, with the true scope and spirit of the invention being indicated by the following claims.

I claim:

1. An apparatus comprising:

a substrate;

a first electron source having a first side, and a second side that is opposite to the first side;

a first focusing electrode adjacent to the first side of the source, the electrode at a first potential;

a second focusing electrode adjacent to the second side of the source and insulated from the first focusing electrode, the second focusing electrode at a second potential; and a screen spaced from the source and the first and the second focusing electrode, the screen at a shield potential and having a plurality of stripes, each stripe having a width;

such that:

the electron source, the first and the second focusing electrodes are all fabricated on and integral with the substrate;

the first and the second focusing electrodes focus and steer a substantial portion of the emitted electrons into a beam towards the screen, with the beam having a beam-width;

the focusing electrodes can steer the beam to strike a stripe and form an image on the screen; and the focusing electrodes can focus the beam-width to be smaller than the width of the stripe.

2. An apparatus as recited in claim 1 wherein the first and the second electrodes are substantially coplanar with the gate of the source on the substrate.

3. An apparatus as recited in claim 2 wherein the substrate is glass.

4. An apparatus as recited in claim 2 further comprising a plurality of electron sources emitting electrons, a substantial portion of the emitted electrons being focused and steered by the first and the second focusing electrode towards the screen.

5. An apparatus as recited in claim 1 further comprising:

a plurality of electron sources next to the first electron sources, the plurality of sources capable of emitting electrons and being in between the first and the second electrode such that the first and the second focusing electrodes focus and steer a substantial portion of the emitted electrons towards the screen.

6. An apparatus as recited in claim 1 wherein the focusing electrodes dynamically steer the beam to strike different stripes on the screen.

7. A flat panel display comprising an apparatus as recited in claim 1.

8. A flat panel display comprising an apparatus as recited in claim 7.

* * * * *